United States Patent [19]

Erhardt et al.

[11] Patent Number: 4,815,149

[45] Date of Patent: Mar. 28, 1989

[54] FABRIC CLOTHING INCLUDING A THREE DIMENSIONAL PATTERN

[76] Inventors: Kurt R. Erhardt, 680 Pritchard Farm Road, Winnipeg, Manitoba, Canada, R2E 0B4; Peter S. Meronek, 7118 Monticello Rd., Columbia, S.C. 29203

[21] Appl. No.: 162,097

[22] Filed: Feb. 29, 1988

[51] Int. Cl.[4] ..... A41B 1/08; A41B 1/18

[52] U.S. Cl. ..... 2/243 B; 2/244; 2/403; 2/406; 40/586

[58] Field of Search ..... 2/244, 243 B, 403, 406, 2/265; 40/586

[56] References Cited

U.S. PATENT DOCUMENTS

| | | | |
|---|---|---|---|
| 368,124 | 8/1887 | Bennett | 2/265 |
| 3,484,974 | 12/1969 | Culmone | 40/586 |
| 4,249,268 | 2/1981 | Berler | 40/586 |
| 4,466,136 | 8/1984 | Bottom et al. | 40/586 |

FOREIGN PATENT DOCUMENTS 2559101 8/1985 France .

*Primary Examiner*—Werner H. Schroeder
*Assistant Examiner*—Jeanette E. Chapman
*Attorney, Agent, or Firm*—Adrian D. Battison; Stanley G. Ade; Murray E. Thrift

[57] ABSTRACT

An article of apparel, generally a T shirt which includes a fabric layer upon which is attached a three dimensional molded article providing a three dimensional relief pattern on a front part of the T shirt to enhance the appearance and provide opportunity for increased sales. The three dimensional molded part includes a flat based disc and raised relief parts with the disc being attached to the T shirt fabric leaving a hollow area between the fabric and the raised parts.

16 Claims, 1 Drawing Sheet

FABRIC CLOTHING INCLUDING A THREE DIMENSIONAL PATTERN

BACKGROUND OF THE INVENTION

This invention relates to an article of clothing which carries a three dimensional molded pattern.

It is currently common place to decorate a T shirt with printed material generally by a silk screening process. These T shirts are widely used and represent a very large volume of business. Some examples of the uses of this technique are advertising and promotion, souvenirs related to tourist attractions, amusing slogans, souvenirs relating to rock bands and other designs which are proposed to appeal to the individual purchasing the shirt. The wide variety of possible materials has led to a very large and wide range in sales for this product.

Up to date, however, the images have simply been two dimensional images provided by a silk screen process. Two dimensional images are of course limited by the very nature of their two dimensional scope. Human beings exist in and experience a three dimensional universe.

It is one object of the present invention, however, to provide a further improvement to the images available to give opportunity to the imaginative designer to provide yet further effects which will appeal to various wearers.

According to the invention, therefore, there is provided an article of clothing comprising a fabric layer arranged to lie flat against the body of a wearer and a three dimensional molded plastic pattern attached to the fabric layer, said pattern including a substantially planar base layer attached to said fabric layer and a relief pattern extending outwardly from the fabric layer defining at least one hollow area between the fabric and the relief pattern.

The existence of the third dimension provided by the relief pattern gives further opportunity for improved designs and important new effects. The present invention provides the imaginative designer with a new frontier in design opportunities by permitting designs which exploit the possibility of 3-D effects. These designs will spawn a new generation of effects which will appeal to various wearers. The invention thus provides a molded three dimensional article comprising a base layer which is substantially planar and one or more relief patterns which are molded to project upwardly therefrom defining a hollow area underneath the pattern. The base layer including a disc of material surrounding the patterns is then attached to the fabric by adhesive, sewing, heat fusion or welding, or other less permanent techniques such as Velcro (trade mark).

The molded pattern can be combined with various other materials such as a printed pattern by the conventional silk screening process surrounding the relief pattern. In addition the hollow area can be used to house batteries, electronics, components such as light emitting diodes, speakers and the like so that the pattern can be used in conjunction with lighting, sound or other effects which will enhance the design.

The molded plastic article provided by the base layer and the relief pattern is preferably formed by injection molding or reaction injection molding from a suitably formed mold. Other molding techniques such as blow molding, vacuum forming, rotational molding or die cast molding can be used for patterns of limited complexity and detail.

In the injection molding process, the initial pattern or master mold can be formed by a vapour deposition process of the type known as nickel vapor forming or other deposition techniques including electrolytic deposition. These techniques can be used to develop a mold having very high detail including the possibility of such fine details as fingerprints, fingernails and the like or other skin textures.

The use of flexible plastics material in the molding technique can allow complex molded patterns which overcome technical difficulties in the "line of draw" or "undercut" of the molded article so as to yield new possibilities in the shape and design of the article.

The material to be molded is preferably of an elastic nature such that the relief pattern formed by the molding technique is elastically compressible to allow it to be comfortably worn by a wearer. That is, the physical properties of the molded article give it a resilience such that it is capable of being deformed by a given stress and upon termination of said stress the molded article will return to its original form without cracking, breaking, loss of shape etc. The thickness and material of the base layer is chosen so that it can structurally support the relief pattern while substantially retaining its planar shape so that the pattern can be attached to the fabric of a shirt without causing or undue deformation of the fabric.

The hollow nature of the molded article ensures that it is of sufficiently light weight generally less than 5 ounces so that it will not cause deformation of the fabric or the article of clothing.

Preferably the base layer is attached to the fabric by a technique which ensures its permanent attachment but involves only upper fibres of the fabric layer so that the fabric retains its fibrous nature on the inner surface for engaging the skin of the wearer. In some cases simple sewing of the base to the fabric around its periphery may be acceptable. The attachment by way of the disc portion surrounding the relief pattern or patterns ensures that a portion of the fabric underneath the relief patterns remains unaffected and hence can contact the skin of the wearer without any detrimental or uncomfortable effect.

One example of an article according to the present invention is shown in the attached drawings in which:

FIG. 1 is a front elevational view of an article of apparel according to the invention.

FIG. 2 is a cross sectional view along the lines 2—2 of FIG. 1.

DESCRIPTION OF THE DRAWINGS

The article of apparel as shown in FIG. 1 comprises a T shirt 10 of conventional form including a front face, sleeves 11 and a neck opening 12. On the front face is provided the three dimensional pattern generally indicated at 13.

The pattern 13 comprises a base layer 14 in the form of a disc surrounding a plurality of raised or relief molded patterns 15. In the example shown the pattern is simply a random pattern chosen as an example but it will be appreciated that artistic and inventive ingenuity will be applied to the design of patterns using this technique. In addition silk screened two dimensional printing is indicated at 16 simply so illustrated that the molded 3-D article can be combined with silk screened images to yield new design effects.

Figure 1:
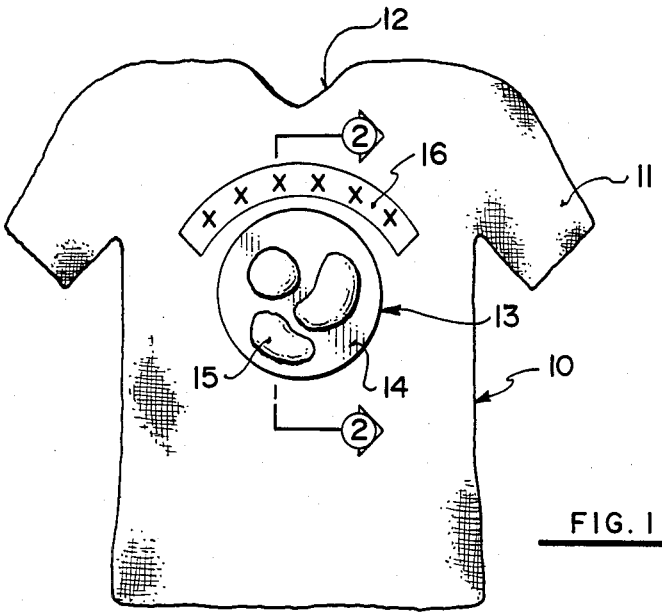
Figure 2:
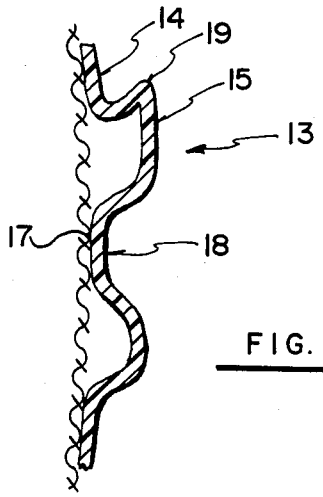
As shown in FIG. 2, the disc 14 is attached to the outer surface of the fabric layer indicated at 17 so that the contact of the disc fully surrounds all of the patterns 15. In addition at a mid position between the patterns as indicated at 18, attachment between the pattern and the fabric is also employed as previously described to ensure that the structure is firmly attached to the fabric and is supported thereby.

As indicated at 19, the patterns may include "undercut" in which an outer part of the pattern is of increased dimension in one direction relative to an underpart thus requiring the molded part to flex as it is pulled out of the mold. This technique is now available when using flexible molding material and can be assisted in the molding process by the pushing action of ejector pins on the molding material to assist its removal from the mold. The material can be formed from any plastics or rubber material.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An article of clothing comprising a fabric layer arranged to lie flat against the body of a wearer and a three dimensional molded plastics pattern attached to the fabric layer, said pattern including a substantially planar base layer attached to said fabric layer and a three dimensional relief pattern extending from the base layer in a direction away from the body of the wearer, the base layer including a portion thereof surrounding the relief pattern which portion is attached to the fabric in a manner defining engagement therebetween fully surrounding the relief pattern.

2. The invention according to claim 1 wherein there is provided at least one hollow area between the fabric and the relief pattern.

3. The invention according to claim 1 wherein the plastics pattern is molded from an elastic material such that the relief pattern is elastically compressible and able to withstand some degree of deformation so that shape is retained and wearer comfort is maximized.

4. The invention according to claim 1 wherein the planar base layer is formed from a material of a thickness such that it is sufficiently flexible such that it can be folded about a line transverse thereto but has sufficient structural rigidity to retain its substantially planar shape and to support the relief pattern when arranged in a vertical orientation.

5. The invention according to claim 1 wherein the article of clothing comprises a shirt and the pattern is arranged on a front portion of the shirt to cover the chest of the wearer.

6. The invention according to claim 1 wherein the fabric is preshrunk before the pattern is attached thereto.

7. The invention according to claim 1 wherein the substantially planar base layer comprises a disc.

8. The invention according to claim 1 wherein the fabric layer includes printed material on the fabric outside of the molded pattern.

9. An article of clothing comprising a fabric layer arranged to lie flat against the body of a wearer and a three dimensional molded plastics pattern attached to the fabric layer, said pattern including a substantially planar base layer directly laminated to said fabric layer and a three dimensional relief pattern extending from the base layer in a direction away from the body of the wearer, wherein there is provided at least one hollow area between the fabric and the relief pattern.

10. The invention according to claim 9 wherein the plastics pattern is molded from an elastic material such that the relief pattern is elastically compressible and able to withstand some degree of deformation so that shape is retained and wearer comfort is maximized.

11. The invention according to claim 9 wherein the planar base layer is formed from a material of a thickness such that it is sufficiently flexible such that it can be folded about a line transverse thereto but has sufficient structural rigidity to retain its substantially planar shape and to support the relief pattern when arranged in a vertical orientation.

12. The invention according to claim 9 wherein the article of clothing is a shirt and the pattern is arranged on a front portion of the shirt to cover the chest of the wearer.

13. The invention according to claim 9 wherein the fabric layer includes printed material on the fabric outside of the molded pattern.

14. An article of clothing comprising a fabric layer arranged to lie flat against the body of a wearer and a three dimensional molded plastics pattern attached to the fabric layer, said pattern including a substantially planar base layer directly laminated to said fabric layer and a three dimensional relief pattern extending from the base layer in a direction away from the body of the wearer, said plastics pattern being molded from an elastic material such that the relief pattern is elastically compressible and able to withstand some degree of deformation so that shape is retained and wearer comfort is maximized, and the planar base layer being formed from a material of a thickness such that it is sufficiently flexible such that it can be folded with the fabric about a line transverse thereto but has sufficient structural rigidity to retain its substantially planar shape and to support the relief pattern when arranged in a vertical orientation.

15. The invention according to claim 14 wherein the article of clothing comprises a shirt and the pattern is arranged on a front portion of the shirt to cover the chest of the wearer.

16. The invention according to claim 14 wherein the fabric layer includes printed material on the fabric outside of the molded pattern.

* * * * *